US008272977B2

(12) United States Patent
Oldknow

(10) Patent No.: US 8,272,977 B2
(45) Date of Patent: Sep. 25, 2012

(54) GOLF SPIN DETECTOR

(75) Inventor: Andrew G. V. Oldknow, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 305 days.

(21) Appl. No.: 12/688,587

(22) Filed: Jan. 15, 2010

(65) Prior Publication Data

US 2011/0177882 A1 Jul. 21, 2011

(51) Int. Cl.
*A63B 37/04* (2006.01)

(52) U.S. Cl. ..... 473/376

(58) Field of Classification Search ..... 473/376
See application file for complete search history.

(56) References Cited

U.S. PATENT DOCUMENTS

| | | | | |
|---|---|---|---|---|
| 676,506 | A | 6/1901 | Knight et al. | |
| 3,980,300 | A * | 9/1976 | Hornsby, Jr. | 473/594 |
| 4,170,352 | A | 10/1979 | Vcala | |
| 4,796,888 | A | 1/1989 | Louez | |
| 5,067,719 | A | 11/1991 | Mook | |
| D429,510 | S | 8/2000 | Sullivan | |
| 6,558,277 | B1 | 5/2003 | Ohira et al. | |
| D506,235 | S | 6/2005 | Kriews et al. | |
| 7,214,145 | B2 | 5/2007 | Park et al. | |
| 7,444,770 | B2 | 11/2008 | Wellington, Jr. | |
| 2003/0181266 | A1 | 9/2003 | Sowders | |
| 2009/0291776 | A1 | 11/2009 | Lin | |
| 2010/0167844 | A1 * | 7/2010 | Sullivan et al. | 473/376 |

FOREIGN PATENT DOCUMENTS

| | | |
|---|---|---|
| WO | 0132270 | 5/2001 |

OTHER PUBLICATIONS

European Search Report dated Mar. 28, 2011 in European Patent Application No. EP 10 19 6367.

* cited by examiner

*Primary Examiner* — Michael Dennis
(74) *Attorney, Agent, or Firm* — Plumsea Law Group, LLC

(57) ABSTRACT

A golf ball includes an inner layer, an outer layer, and a cavity therebetween. A pigment is placed in the cavity. When the ball is struck, the pigment moves from a consolidated position to a dispersed position adjacent the outer layer. An observation of the dispersed pigment informs the golfer of the spin imparted to the ball.

18 Claims, 7 Drawing Sheets

GOLF SPIN DETECTOR

FIELD

The present embodiments relate generally to a golf ball that appears to change color. More specifically, the present embodiments relate generally to a golf ball having an outer layer containing different pigment colors.

BACKGROUND

It is desirable to provide a golfer an indication of how much spin, particularly backspin, the golfer is imparting to a ball. While a golfer may be able to make this determination by noting the rotation of an imprint on a ball, once the ball has flown a relatively short distance, a golfer's eyes are likely not sharp enough to make any sort of determination of how much spin is on the ball. While the final placement of the ball may give an additional indication of spin, the green surface and slope will affect the amount of backward movement of the ball, making it difficult for a golfer to accurately determine whether any changes to a swing have an effect on the spin.

It is also helpful if a golfer can see the flight of a ball. Seeing the flight of the ball can assist a golfer in changing swing characteristics to create a different trajectory. It is also useful to see the flight path of the ball in order to locate the ball for further play. When the day is bright, it is often difficult to follow the flight of a white ball against the sky.

Accordingly, it may be helpful to provide a ball that improves both conditions by providing a ball that provides a different color contrast against the sky to assist a golfer in determining the flight path of a ball and that also assists a golfer in determining the spin of the ball.

SUMMARY

In one embodiment, an outer composite layer of golf ball is included. The outer composite layer includes an outer translucent layer, an inner layer, and a first pigment between the outer layer and the inner layer.

In another embodiment, a golf ball includes a core and a cover. The core includes an inner layer. The cover is radially outward of the core and includes an outer layer and a pigment in a cavity between the inner layer and the outer layer.

Dividers may be placed between the inner layer and the outer layer to separate the cavity into a first portion and a second portion. Differently colored pigments may be placed into each cavity portion.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

The embodiments disclosed relate to golf balls that have varying configurations that include two pigments. The pigments are movable relative to each other and the outer surface and therefore, the apparent color of the ball changes depending on the spin of the ball.

Figure 1:
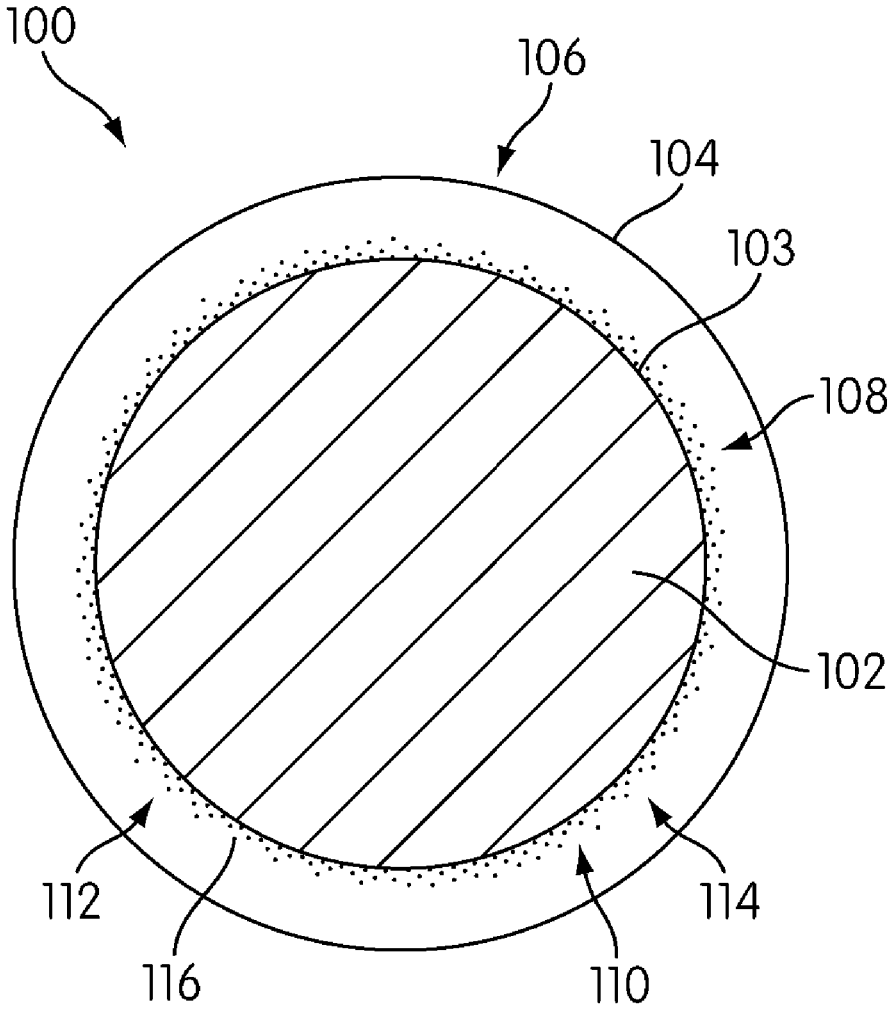
FIG. 1 is a cross-sectional view of an embodiment.

FIG. 1 is a cross section of an embodiment of golf ball 100. Golf ball 100 has a series of radially or circumferentially arranged layers. The innermost layer is core 102. Core 102 can be any of a variety of cores commonly used in golf balls. For example, core 102 could be liquid filled or solid filled. The solid may be rubber, resin, or any other suitable material. The core may also include various types of weights. Core 102 may also include a wound cover. A person having ordinary skill in the art can select a core that produces the technical and flight characteristics that are desirable. An optional mantle layer is not specifically shown in the FIGS., but may surround and may be positioned outward of core 102. Inner layer 103 is shown in FIG. 1 as being the outer surface of core 102, but may instead be defined by an outer surface of the optional mantle layer or another layer outward of core 102.

Top or outer layer 104 is radially or circumferentially outward of the inner layer 103 and is shown in simplified form. In a commercial version, the outer layer, and in particular, outer surface 106 of outer layer 104, is configured to be struck by a golf club. Accordingly, outer layer 104 may include various dimples, frets or lands, projections, printing, or any other features that a designer thinks would be desirable in affecting the flight path of the ball 100. Outer layer 104 may be designed to be scuff resistant. In the embodiment of FIG. 1, outer layer 104 is translucent. Inner layer 103 and outer layer 104 are spaced from one another and a space or cavity 108 is between the inner layer 103 and outer layer 104.

Between inner layer 103 and outer layer 104 is a first fluid 110. First fluid 110 may have a variety of properties. However, it is desirable that the molecules or particles that comprise first fluid 110 be able to move in the cavity 108. First fluid 110 may be made of a variety of types of materials or of a single material. Some materials comprising first fluid 110 may have greater density or viscosity than others. First fluid 110 may include pigments having two colors. The two colors can be any two colors that are distinguishable from one another. First pigment 112 is a first color and second pigment 114 is a second color different from the first color.

It may be desirable for outer layer 104 of any of the disclosed embodiments to be translucent or transparent. A transparent ball is also translucent. The use of a first fluid having multiple colors is most useful if the color difference can be seen or determined through the outer layer.

In many of the embodiments disclosed, one pigment may be colored white. The selection of white as a color may be desirable so the ball retains the same general external appearance as a ball not equipped with the features of the varying embodiments. If the outer layer is transparent, the other color may be any non-white color, but may desirably be orange. If the outer layer is translucent, but not transparent, the other color must be selected to contrast sufficiently with the one pigment that the distinction is apparent through a translucent outer layer. In the embodiments shown herein, one of the pigments is shown via stippling and another is shown by open space. A third pigment is shown by asterisks. While this manner of illustration in the FIGS. may give the appearance that only some of the pigments are made of individually distinguishable particles and others are not, the use of stippling for one color and lack of stippling for the other color is merely for ease of illustration and does not indicate a different sort of pigment.

The FIGS. illustrate layers having a variety of thicknesses. These thicknesses should not be considered to be the only possible thicknesses for the layers. The desirable thicknesses for the various layers depends on the materials a designer wishes to use and the protection or reactivity the designer wishes to provide by using the various layers. A person having ordinary skill in the art can modify the present embodiments to provide for a ball having layers of appropriate thicknesses.

Turning again to the embodiment shown in FIG. 1, inner layer 103 and first pigment 112 are selected to mutually attract one another. For example, one of the inner layer and the pigment could include a magnetic element and the other could include a magnetically active metal that is attracted to the magnetic element. Alternatively, inner layer 103 and first pigment 112 could have various types of ionic or other attraction that cause the first pigment to settle into a consolidated position along the surface of inner layer 103 when ball 100 is at rest. In such an instance, it may be desirable for inner layer 103 to be a separate layer from the core. As shown in FIG. 1, the first pigment 112 may be a plurality of pigment particles 116.

Figure 2:
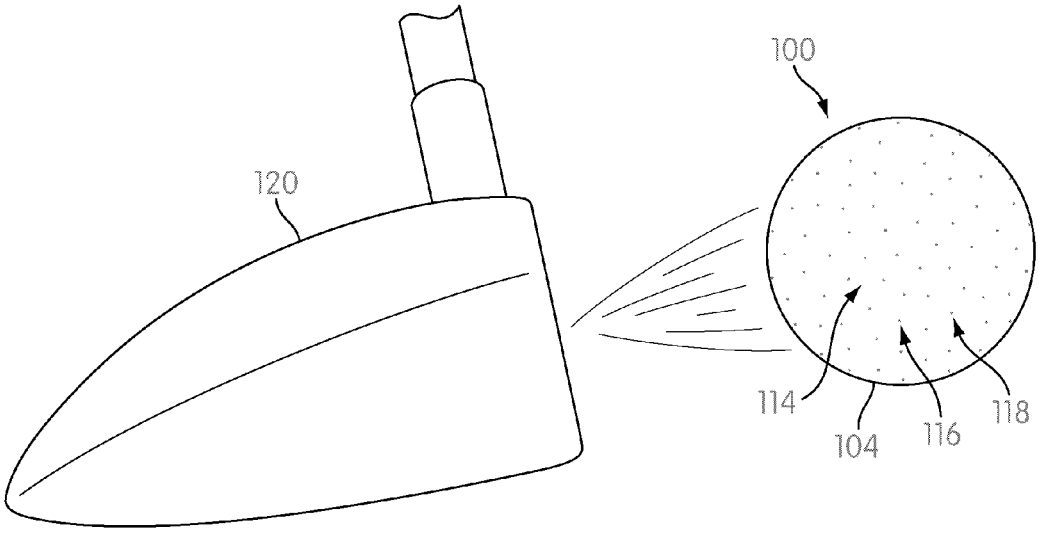
FIG. 2 is a view showing a golf club and the embodiment of FIG. 1 just after impact.

FIG. 2 is a schematic showing ball 100 just after impact by club 120. As shown in FIG. 2, the impact of club 120 against ball 100 imparts a spin to ball 100. Regardless of which club is selected or how the ball is struck, it is highly likely that some sort of spin will be imparted to the ball. In many cases, the spin imparted to the ball will create a force on each pigment particle 116 in first pigment 112. This force may be a centrifugal force, in whole or in part. The force may be sufficient to overcome the attractive force between first pigment 112 and inner layer 103. This may cause one or more of pigment particles 116 to leave the consolidated position shown in FIG. 1 and move to a dispersed position, as is shown by an exemplary pigment particle 118 visible through outer layer 104 among the particles of second pigment 114.

Figure 3:
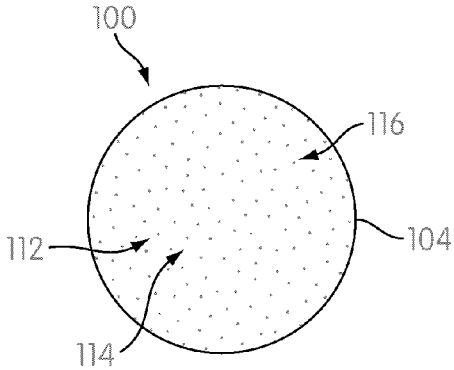
FIG. 3 is a view showing the ball of FIG. 1 after impact.

FIG. 3 shows ball 100 after the first pigment 112 and first pigment particles 116 have reached a dispersed position. The density of first pigment particles 116 relative to particles of second pigment 114 measures the amount of spin imparted to ball 100 by the stroke of club 120. This measurement indicates to a golfer how much spin is applied or imparted to ball 100 by his or her stroke. Once ball 100 finishes its flight and roll after the stroke, first pigment 112 returns to the consolidated position shown in FIG. 1 after an effective length of time. The effective length of time will vary depending on factors such as the relative density of the first pigment and the second pigment, the amount of spin imparted to the ball, and the air temperature. These factors are not exclusive, but will depend on other factors as well.

It may be desirable in this or other embodiments for the pigments used to be of different and possibly contrasting colors. It may also be desirable for the pigments used to be UV reactive. In such an instance, the pigments would be arranged in the same manner as disclosed. However, when exposed to light from the sun or another UV source, the pigments would change from one color to another. In some instances, it may be desirable to select pigments that all appear white when not exposed to UV light in order to preserve an overall white appearance of the ball. In such an instance, when the ball is exposed to UV light during the course of play, the pigments would change color in flight and then could be capable of returning to a white color at rest. In such an instance, where the present disclosure refers to pigments having differing colors, these colors would be the colors that the pigments would have upon UV exposure, rather than their colors without such exposure.

Figure 4:
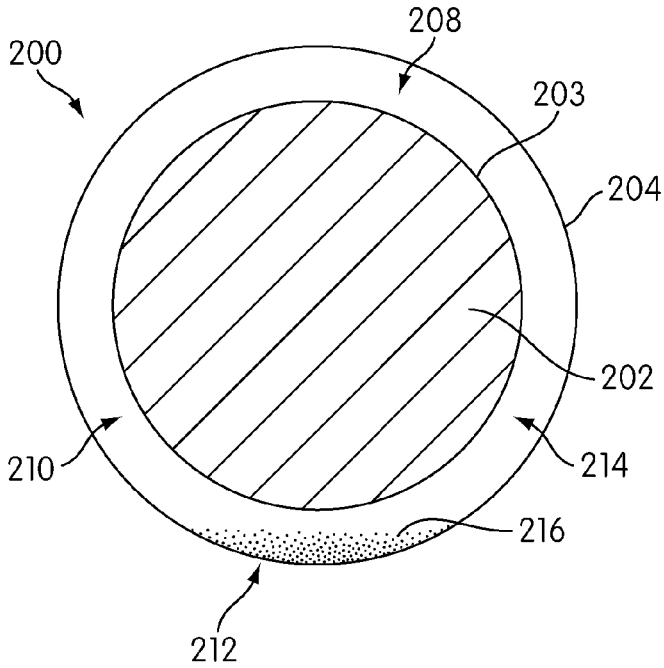
FIG. 4 is a cross-sectional view of another embodiment.

An alternative embodiment is shown in FIGS. 4-7. FIG. 4 is a cross section of an embodiment of golf ball 200. Golf ball 200 has a series of radially or circumferentially arranged layers. The innermost layer is core 202. Core or 202 has the same properties as described above in connection with core 102 and inner layer 203 has the same properties as described above in connection with inner layer 103. Top or outer layer 204 is radially or circumferentially outward of inner layer 203 and has the same properties as described above in connection with outer layer 104. Inner layer 203 and outer layer 204 are spaced from one another and a space or cavity 208 is between the inner layer 203 and outer layer 204.

Between inner layer 203 and outer layer 204 is a first fluid 210. First fluid 210 may have a variety of properties. However, it is desirable that the molecules or particles that comprise first fluid 210 be able to move in the cavity 208. First fluid 210 may be made of a variety of types of materials or of a single material. Some materials comprising first fluid 210 may have greater density or viscosity than others. First fluid 210 may include pigments having two colors. The two colors can be any two colors that are distinguishable from one another. First pigment 212 is a first color and second pigment 214 is a second color different from the first color.

In FIG. 4, ball 200 is in a rest position and first pigment 212 has settled to the bottom of cavity 208 in its consolidated position. Among the reasons pigment particles 216 of first pigment 212 may settle to the bottom of the cavity 208 is if first pigment particles 216 on average are of a higher density or weight than particles of second pigment 214.

Figure 5:
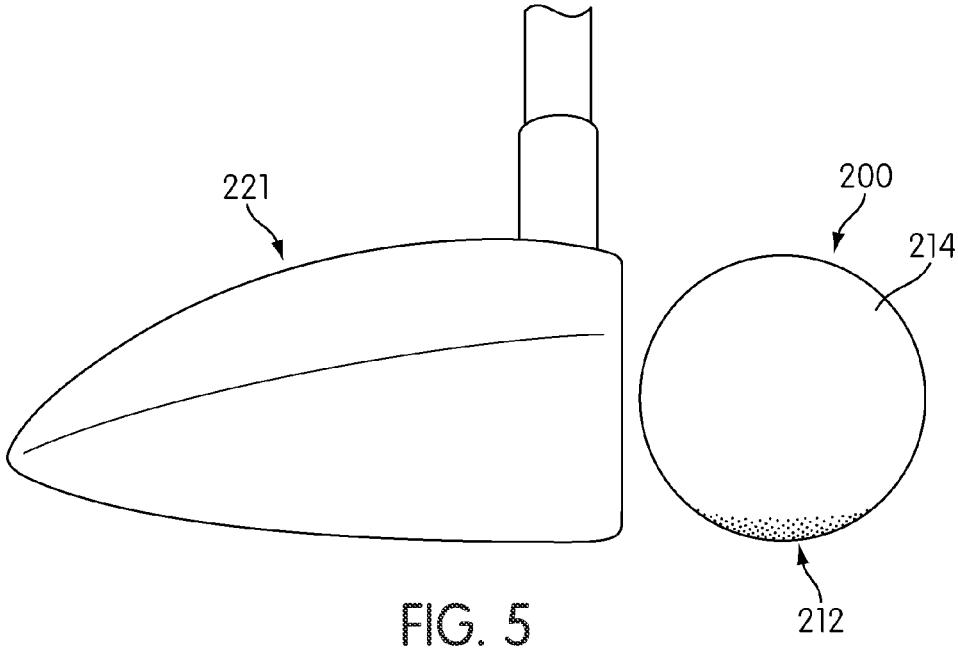
FIG. 5 is a view showing a golf club and the embodiment of FIG. 4 at rest.
Figure 6:
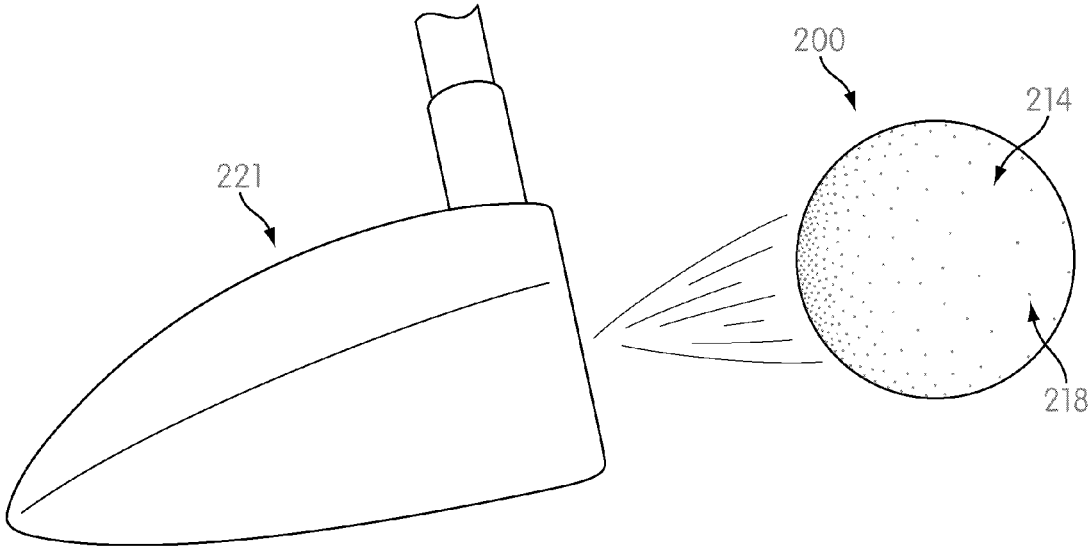
FIG. 6 is a view showing the golf club and ball of FIG. 5 just after impact.

FIG. 5 shows ball 200 in its rest position just before it is struck by club 221. In FIG. 5, first pigment 212 is shown in its consolidated position on the bottom of ball 200. FIG. 6 shows ball 200 just after impact by club 221. As shown in FIG. 6, the impact of club 221 against ball 200 imparts a spin to ball 200. Regardless of which club is selected or how the ball is struck, it is highly likely that some sort of spin will be imparted to the ball. In many cases, the spin imparted to the ball will create a force on each pigment particle 216 in first pigment 212. This force may be a centrifugal force, in whole or in part. The force may be sufficient to cause one or more of pigment particles 216 to leave the consolidated position and move to a dispersed position, as is shown by an exemplary pigment particle 218 visible through outer layer 204 among the particles of second pigment 214.

Figure 7:
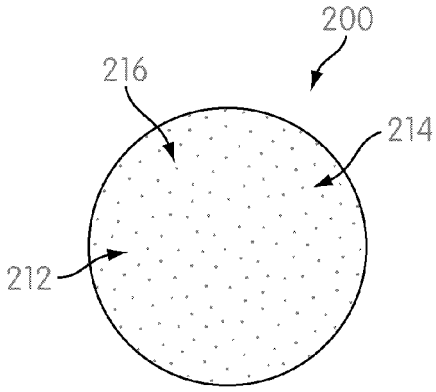
FIG. 7 is a view showing the ball of FIG. 4 after impact.

FIG. 7 shows ball 200 after the first pigment 212 and first pigment particles 216 have reached a dispersed position. The density and evenness of the distribution of first pigment particles 216 relative to particles of second pigment 214 measure the amount of spin imparted to ball 200 by the stroke of club 221. This measurement indicates to a golfer how much spin is applied or imparted to ball 200 by his or her stroke. Once ball 200 finishes its flight and roll after the stroke, first pigment 212 returns to the consolidated position shown in FIG. 4 after an effective length of time. The effective length of time will vary depending on factors such as the relative density of the first pigment and the second pigment, the amount of spin imparted to the ball, and the air temperature. These factors are not exclusive, but will depend on other factors as well.

The remaining FIGS. (FIGS. 8-13) show other varying embodiments. Each of these embodiments shows a first pigment that settles to the bottom of a cavity or cavity portion similar to the embodiment shown in FIGS. 4-7. However, in any or all of these embodiments, the first pigment could instead be attracted to the inner layer, as shown in FIGS. 1-3. In addition, in any of these embodiments, some pigments may be selected to be attracted to the inner layer in some cavity sections and others to settle to the bottom of the cavity in other cavity sections. The placement of the pigments in the cavities and the precise formulation is left what a designer believes is useful or desirable.

Figure 8:
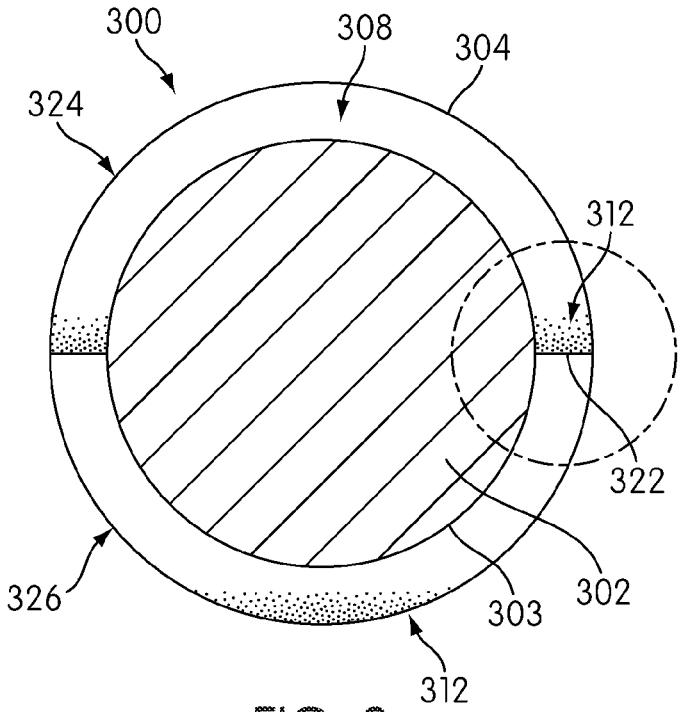
FIG. 8 is a cross-sectional view of another embodiment.

FIG. 8 shows a cross section of another embodiment of a golf ball 300. Golf ball 300 has a series of radially or circumferentially arranged layers. The innermost layer is core 302. Core 302 has the same properties as described above in connection with core 102 and inner layer 303 has the same properties as described above in connection with inner layer 103. Top or outer layer 304 is radially or circumferentially outward of inner layer 303 and has the same properties as described above in connection with outer layer 104. Inner layer 303 and outer layer 304 are spaced from one another and a space or cavity 308 is between the inner layer 303 and outer layer 304. A fluid may be present in cavity 308.

As shown in FIG. 8, it may be desirable in some embodiments to include divider 322 in ball 300 extending between inner layer 303 and outer layer 304. Divider 322 is shown in FIG. 8 as being annular and placed around a circumference of ball 300. Divider 322 divides cavity 308 into two substantially equal portions, specifically, first cavity portion 324 and second cavity portion 326. The use of a divider need not so separate cavity 308 and may instead separate cavity 308 into two dissimilarly sized portions. In addition, a divider could instead be used that is localized in a particular point or region and does not function as a divider. The divider may be considered to be a separator, separating the cavity into a plurality of spaces or separating the inner layer from the outer layer. FIG. 8 shows one possible rest position of ball 300; if ball 300 fell at a different angle to the ground, divider 322 would be positioned at a different angle relative to the ground.

Figure 9:
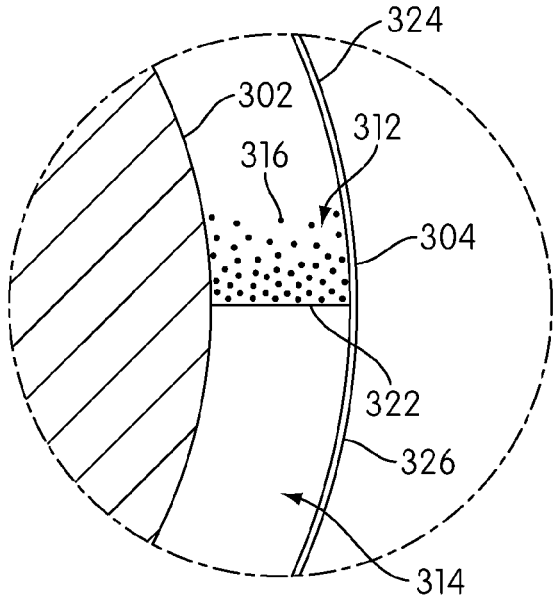
FIG. 9 is a detailed cross-sectional view of the embodiment of FIG. 8.

FIG. 9 is a closer view of one portion of ball 300. FIGS. 8 and 9 show the use of first pigment 312 and second pigment 314. First pigment 312 and second pigment 314 have the same properties as described above in connection with first pigment 112 and second pigment 114, respectively. In FIGS. 8 and 9, ball 300 is in a rest position and first pigment 312 has settled to the bottom of each of first cavity portion 324 and second cavity portion 326 in its consolidated position. Among the reasons pigment particles 316 of first pigment 312 may settle to the bottom of first cavity portion 324 and second cavity portion 326 is if first pigment particles 316 on average are of a higher density or weight than particles of second pigment 314. When ball 300 is struck, first pigment particles 316 will disperse more evenly into second pigment 314 in a dispersed position. The greater weight or density of first pigment 312 may cause the first pigment to be more greatly affected by the spin and to disperse more towards outer layer 304, causing them to be visible over a greater portion of outer layer 304. When ball 300 comes to its next rest position, first pigment 312 will again settle to the bottom of each of first cavity portion 324 and second cavity portion 326.

Figure 10:
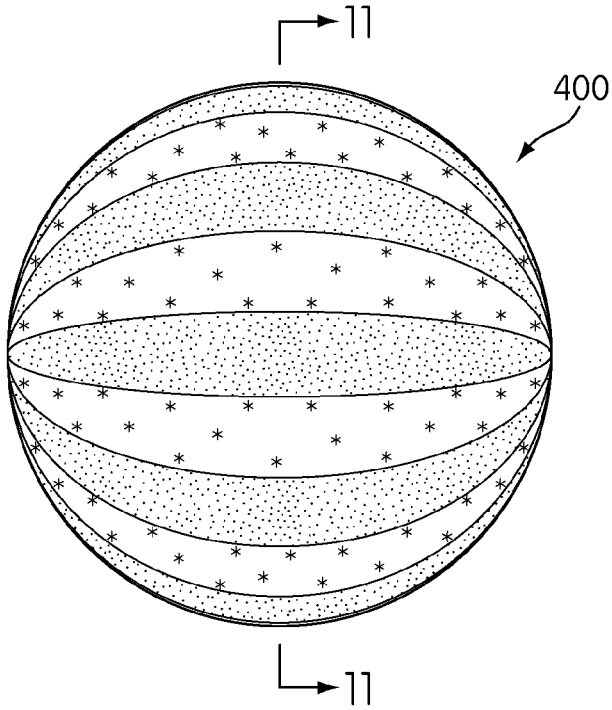
FIG. 10 is a plan view of another embodiment.
Figure 11:
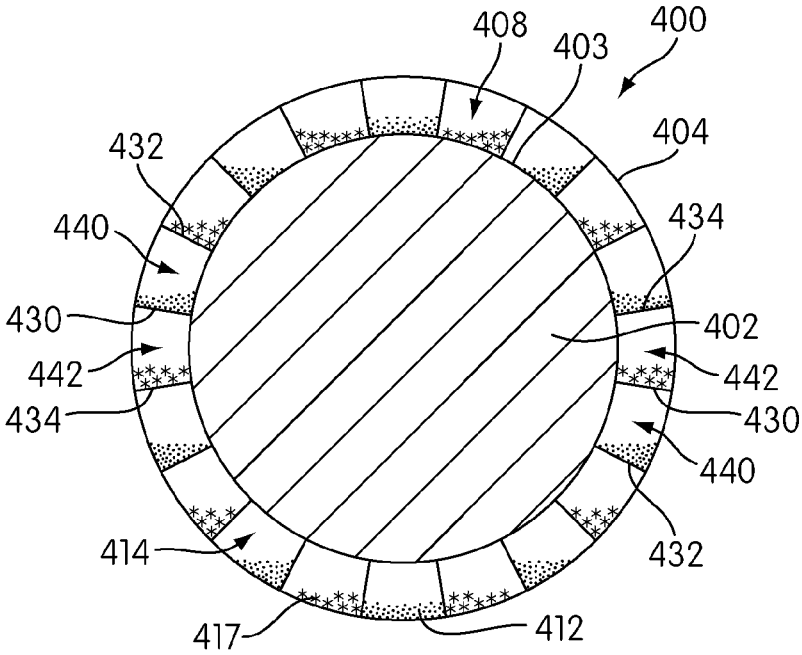
FIG. 11 is a cross-sectional view of the embodiment of FIG. 10.

FIGS. 10 and 11 show another embodiment of a golf ball 400. FIG. 10 shows a plan view of golf ball 400 with pigments in a dispersed position, while FIG. 11 shows a cross section of golf ball 400 with pigments in a consolidated position. Golf ball 400 has a series of radially or circumferentially arranged layers. The innermost layer is core 402. Core 402 has the same properties as described above in connection with core 102 and inner layer 403 has the same properties as described above in connection with inner layer 103. Top or outer layer 404 is radially or circumferentially outward of inner layer 403 and has the same properties as described above in connection with outer layer 104. Inner layer 403 and outer layer 404 are spaced from one another and a space or cavity 408 is between inner layer 403 and outer layer 404. A fluid may be present in the cavity 408.

As shown most clearly in FIG. 11, it may be desirable in some embodiments to include a plurality of dividers in ball 400 extending between inner layer 403 and outer layer 404. First divider 430 is shown in FIG. 11 as being annular and placed around a circumference of ball 400. Second divider 432 is annular and spaced from and adjacent to first divider 430. Third divider 434 is annular and spaced from and adjacent to first divider 430 and on the opposite side of first divider 430 from second divider 432. In the embodiment shown in FIGS. 10 and 11, a plurality of equally spaced dividers is shown. First divider 430, second divider 432, and third divider 434 divide cavity 408 into portions, including first cavity portion 440 and second cavity portion 442. Each pair of adjacent dividers similarly provides a cavity portion therebetween in the embodiment shown in FIGS. 10 and 11. FIG. 11 shows one possible rest position of ball 400.

FIGS. 10 and 11 show the use of first pigment 412, second pigment 414, and third pigment 417. First pigment 412 and third pigment 417 generally have the same properties as described above in connection with first pigment 112. Second pigment 414 generally has the same properties as described above in connection with second pigment 114. In FIG. 11, ball 400 is in a rest position and first pigment 412 and third pigment 417 have settled to the bottom of each of first cavity portion 440 and second cavity portion 442, respectively, in a consolidated position. First pigment 412 is on a first side of divider 430 and third pigment 417 is on a second side of divider 430. Similarly, first pigment 412 is on a first side of divider 432 and third pigment 417 is on a second side of divider 432. Among the reasons pigment particles of first pigment 412 may settle to the bottom of first cavity portion 440 and third pigment 417 may settle to the bottom of the second cavity portion 442 is if pigment particles of first pigment 412 and third pigment 417 on average are of a higher density or weight than particles of second pigment 414. When ball 400 is struck, pigment particles of first pigment 412 and third pigment 417 will disperse more evenly into second pigment 414 in a dispersed position, such as that shown in FIG. 10. The greater weight or density of first pigment 412 and third pigment 417 may cause the first pigment and third pigment to be more greatly affected by the spin and to disperse more towards outer layer 404, possibly due in whole or in part to centrifugal force, causing them to be visible over a greater portion of outer layer 404. When ball 400 comes to its next rest position, first pigment 412 will again settle to the bottom of first cavity portion 440 and third pigment 417 will again settle to the bottom of second cavity portion 442.

FIG. 10 shows a striped pattern that may emerge when first pigment 412 and third pigment 417 are spun outwardly to a dispersed position, possibly created entirely or in part by centrifugal force by the rotation of the ball due to backspin. The use of such a pattern may allow ball 400 to have a reduced wait time before it may be struck again. When a ball having no dividers is used, the first pigment must return to a rest position without a boundary, which may be traveling a significant portion of the diameter of the ball without a diameter. When a divider is used, the pigment may only need to travel a short distance to return to a consolidated position. The use of a striped pattern may also be useful to determine spin more accurately. First pigment 412 may have a first color, second pigment 414 may have a second color, and third pigment 417 may have a third color. The first color, second color, and third color may all be different from one another. The first color and the third color may be generally primary colors that combine to form a secondary color. For example, the first color could be blue and the third color could be yellow, which would form green. The color visible to the eye would vary depending on the spin of the ball and the varying weights of the pigments. For example, a more blue-green could indicate a particular type of spin, while a yellow-green could indicate a different type of spin. This information may be useful to a golfer in changing stroke characteristics.

Figure 12:
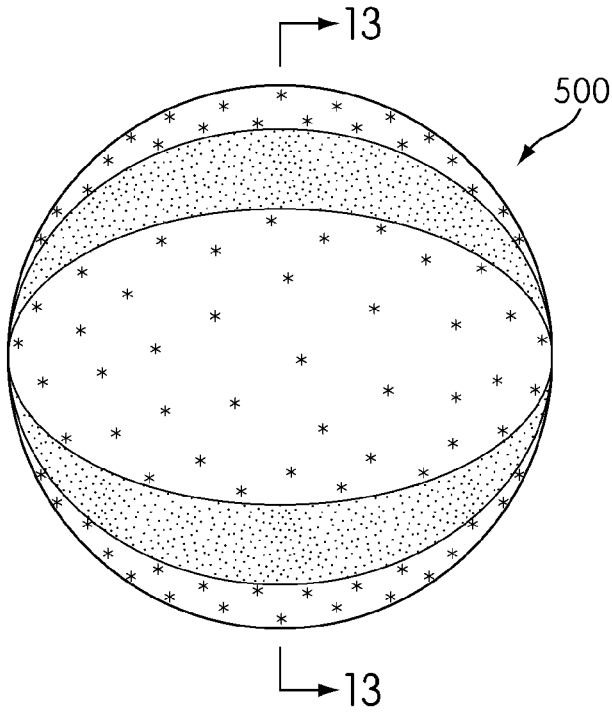
FIG. 12 is a plan view of another embodiment.
Figure 13:
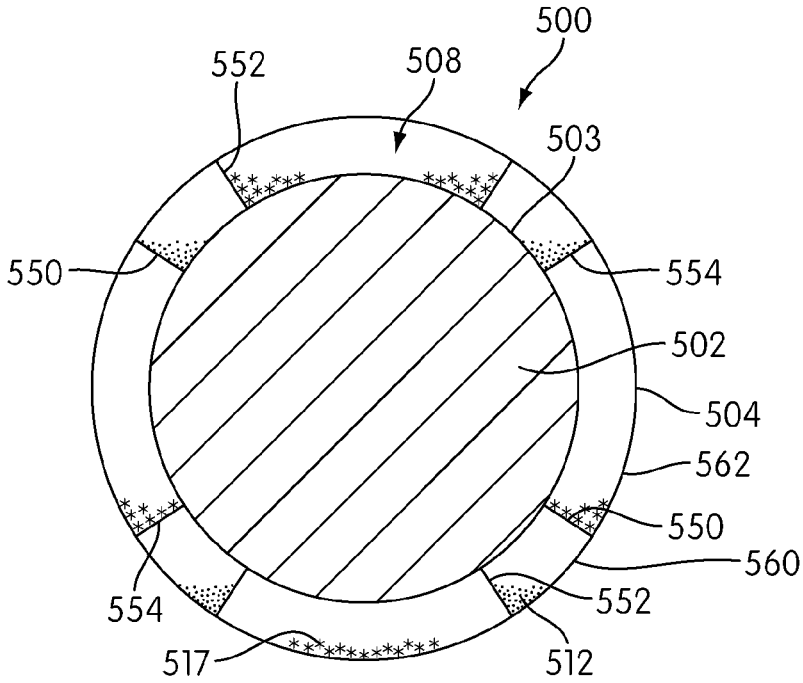
FIG. 13 is a cross-sectional view of the embodiment of FIG. 12.

FIGS. 12 and 13 show another embodiment of a golf ball 500. FIG. 12 shows a plan view of golf ball 500 with pigments in a dispersed position, while FIG. 13 shows a cross section of golf ball 500 with pigments in a consolidated position. Golf ball 500 has a series of radially or circumferentially arranged layers. The innermost layer is core 502. Core 502 has the same properties as described above in connection with core 102 and inner layer 503 has the same properties as described above in connection with inner layer 103. Top or outer layer 504 is radially or circumferentially outward of inner layer 503 and has the same properties as described above in connection with outer layer 104. Inner layer 503 and outer layer 504 are spaced from one another and a space or cavity 508 is between inner layer 503 and outer layer 504. A fluid may be present in the cavity 508.

As shown most clearly in FIG. 13, it may be desirable in some embodiments to include a plurality of dividers in ball 500 extending between inner layer 503 and outer layer 504. First divider 550 is shown in FIG. 13 as being annular and placed around a circumference of ball 500. Second divider 552 is annular and spaced from and adjacent to first divider 550. Third divider 554 is annular and spaced from and adjacent to first divider 550 and on the opposite side of first divider 550 from second divider 552. In the embodiment shown in FIGS. 12 and 13, the dividers are regularly, but unevenly, spaced. First divider 550, second divider 552, and third divider 554 divide cavity 508 into portions, specifically first cavity portion 560 and second cavity portion 562. Each pair of adjacent dividers similarly provides a cavity portion therebetween in the embodiment shown in FIGS. 12 and 13. FIG. 13 shows one possible rest position of ball 500.

FIGS. 12 and 13 show the use of first pigment 512, second pigment 514, and third pigment 517. First pigment 512 and third pigment 517 generally have the same properties as described above in connection with first pigment 112. Second pigment 514 generally has the same properties as described above in connection with second pigment 114. In FIG. 13, ball 500 is in a rest position and first pigment 512 and third pigment 517 have settled to the bottom of each of first cavity portion 560 and second cavity portion 562, respectively, in a consolidated position. First pigment 512 is on a first side of divider 550 and third pigment 517 is on a second side of divider 550. Similarly, first pigment 512 is on a first side of divider 552 and third pigment 517 is on a second side of divider 552. Among the reasons pigment particles of first pigment 512 may settle to the bottom of first cavity portion 560 and third pigment 517 may settle to the bottom of second cavity portion 562 is if pigment particles of first pigment 512 and third pigment 517 on average are of a higher density or weight than particles of second pigment 514. When ball 500 is struck, pigment particles of first pigment 512 and third pigment 517 will disperse more evenly into the second pigment 514 in a dispersed position, such as that shown in FIG. 12. The greater weight or density of first pigment 512 and third pigment 517 may cause the first pigment and third pigment to be more greatly affected by the spin and to disperse more towards outer layer 504, possibly due in whole or in part to centrifugal force, causing them to be visible along a greater portion of outer layer 504. When ball 500 comes to its next rest position, first pigment 512 will again settle to the bottom of first cavity portion 560 and third pigment 517 will again settle to the bottom of third cavity portion 562.

FIG. 12 shows a striped pattern that may emerge when first pigment 512 and third pigment 517 are spun outwardly to a dispersed position. The use of such a pattern may allow ball 500 to have a reduced wait time before it may be struck again. When a ball having no dividers is used, the first pigment must return to a rest position without a boundary, which may be traveling a significant portion of the diameter of the ball without a diameter. When a divider is used, the pigment may only need to travel a short distance to return to a consolidated position. The use of a striped pattern may also be useful to determine spin more accurately. First pigment 512 may have a first color, second pigment 514 may have a second color, and third pigment 517 may have a third color. The first color, second color, and third color may all be different from one another. The first color and the third color may be generally primary colors that combine to form a secondary color. For example, the first color could be blue and the third color could be yellow, which would form green. The color visible to the eye would vary depending on the spin of the ball and the varying weights of the pigments. For example, a more blue-green could indicate a particular type of spin, while a yellow-green could indicate a different type of spin. This information may be useful to a golfer in changing stroke characteristics. In the embodiment of FIGS. 12 and 13, since some cavity portions, such as first cavity portion 560, are smaller than other cavity portions, such as second cavity portion 562, the pigment in the smaller cavity portion, in this case first pigment 512 is likely to disperse and reach the outer layer 504 more quickly than the pigment in the larger cavity portion, in this case third pigment 517. The use of such a gradation in size is likely to assist in determining a spin rate. If a spin rate is slower, less force is imparted to the pigment. The first color would dominate the ball. If a spin rate is higher, the second color would instead dominate the ball. Accordingly, the use of such a striped pattern may assist a golfer in determining a rate of spin.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An outer composite layer of a golf ball, comprising:

an outer layer, wherein the outer layer is translucent;

an inner layer;

a cavity between the inner layer and the outer layer; and a first pigment and a fluid between the outer layer and the inner layer, wherein particles of the first pigment are capable of moving in the cavity;

wherein the first pigment has a greater density than the fluid in the cavity; and wherein the outer composite layer is positioned radially outward of a golf ball core.

2. The outer composite layer according to claim 1, wherein the pigment is capable of moving from a consolidated position to a dispersed position when spin is imparted to the ball.

3. The outer composite layer according to claim 2, wherein the pigment is capable of returning to the consolidated position when the ball returns to a rest position.

4. The outer composite layer according to claim 1, further comprising a first divider extending between the outer layer and the inner layer.

5. The outer composite layer according to claim 4, wherein the first pigment is on a first side of the divider and a second pigment is on a second side of the divider.

6. The outer composite layer according to claim 5, wherein the first pigment has a first color and the second pigment has a second color different from the first color.

7. The outer composite layer according to claim 4, further comprising a plurality of dividers extending between the outer layer and the inner layer defining a plurality of cavity portions.

8. The outer composite layer according to claim 7, wherein at least one pigment is in each of the plurality of cavity portions.

9. The outer composite layer according to claim 8, wherein the first pigment has a first color and is in a first one of the plurality of cavity portions and a second pigment has a second color different from the first color and is in a second one of the plurality of cavity portions.

10. The outer composite layer according to claim 1, wherein the pigment and inner layer attract one another.

11. A golf ball, comprising:

a core, the outer surface of the core comprising an inner layer;

a cover radially outward of the core, comprising an outer layer;

a cavity defined between the core and the cover;

a pigment capable of moving within the cavity; and a fluid in the cavity, wherein the fluid has a first density and the pigment has a second density, and wherein the first density is less than the second density.

12. The golf ball according to claim 11, further comprising a separator between the inner layer and the outer layer.

13. The golf ball according to claim 12, wherein the cavity is a first cavity portion on a first side of the separator and a second cavity portion on a second side of the separator and wherein the pigment is in at least one of the cavity portions.

14. The golf ball according to claim 13, wherein a first pigment is positioned in the first cavity portion and a second pigment is positioned in the second cavity portion.

15. The golf ball according to claim 14, wherein the first pigment has a first color and the second pigment has a second color different from said first color.

16. The golf ball according to claim 11, wherein the pigment moves relative to outer layer when spin is imparted to the ball.

17. The golf ball according to claim 11, wherein the outer layer is translucent.

18. The golf ball according to claim 11, wherein the pigment and inner layer attract one another.

* * * * *